US010426242B1

(12) United States Patent
Little

(10) Patent No.: US 10,426,242 B1
(45) Date of Patent: Oct. 1, 2019

(54) PORTABLE SUPPORT FOR A BODY PART

(71) Applicant: Deborah Little, Slade, KY (US)

(72) Inventor: Deborah Little, Slade, KY (US)

( * ) Notice: Subject to any disclaimer, the term of this patent is extended or adjusted under 35 U.S.C. 154(b) by 0 days.

(21) Appl. No.: 15/918,328

(22) Filed: Mar. 12, 2018

(51) Int. Cl.

| | |
|---|---|
| ***A45F 3/00*** | (2006.01) |
| ***A47G 9/10*** | (2006.01) |
| ***A45C 15/00*** | (2006.01) |
| ***A45C 3/06*** | (2006.01) |
| ***A45F 4/02*** | (2006.01) |
| ***A47C 16/00*** | (2006.01) |

(52) U.S. Cl.
CPC ..... *A45C 15/00* (2013.01); *A45C 3/06* (2013.01); *A45F 3/005* (2013.01); *A45F 4/02* (2013.01); *A47C 16/00* (2013.01); *A47G 9/1045* (2013.01); *A47G 9/1081* (2013.01); *A45F 2003/003* (2013.01); *A47G 2009/1018* (2013.01)

(58) Field of Classification Search
CPC ..... A45C 3/14; A45C 2009/007; A45F 3/02; A45F 2004/003; A45F 4/02; A45F 2004/026; A47G 9/1081; A47G 9/109
See application file for complete search history.

(56) References Cited

U.S. PATENT DOCUMENTS 3,998,304 A * 12/1976 Edgerton, Jr. ..... A45C 3/00 190/107
4,176,772 A * 12/1979 Danon ..... A45F 3/20 224/148.5
4,188,988 A * 2/1980 Agyagos ..... A45C 3/00 190/2
4,236,657 A * 12/1980 Brunton ..... A45F 3/04 190/111
4,746,159 A * 5/1988 Webb ..... A63C 11/023 206/315.1
4,852,778 A * 8/1989 Beiser ..... A45F 3/02 224/417
5,119,519 A * 6/1992 Foreman ..... A47G 9/1045 190/1
5,139,187 A * 8/1992 Fowler ..... A41D 13/081 2/162
5,228,609 A * 7/1993 Gregory ..... A45F 3/02 224/617
5,452,476 A * 9/1995 Jenks ..... A41D 3/00 2/108
5,572,757 A * 11/1996 O'Sullivan ..... A47C 7/46 297/284.5
5,645,080 A * 7/1997 Toso ..... A47C 16/00 128/876
D391,109 S * 2/1998 Miller ..... D6/596
6,126,054 A * 10/2000 Riemer ..... A45C 13/1046 224/601
6,471,105 B1 * 10/2002 Ammerman ..... A45C 13/30 150/110
6,708,343 B1 3/2004 Ceron
7,185,378 B2 * 3/2007 Smith ..... A45C 13/26 128/DIG. 23
7,575,376 B2 * 8/2009 Yu ..... A45C 7/0077 190/103
8,141,704 B2 * 3/2012 Ruhle ..... A45C 7/0077 206/315.2

(Continued)

*Primary Examiner* — Brian D Nash
(74) *Attorney, Agent, or Firm* — Kenneth F. Pearce

(57) ABSTRACT

A portable support adapted to support a part of the human body. The portable support is provided with an inner cavity capable of carrying one or more articles.

19 Claims, 6 Drawing Sheets

(56) References Cited

U.S. PATENT DOCUMENTS

| | | | | |
|---|---|---|---|---|
| 8,893,332 | B2 | 11/2014 | Kavovit | |
| 9,155,409 | B2 * | 10/2015 | Cohen | A47G 9/10 |
| D793,714 | S * | 8/2017 | Zhou | D3/203.1 |
| 9,756,921 | B2 * | 9/2017 | Bergman | A45C 9/00 |
| 9,901,160 | B2 * | 2/2018 | Donato, Jr. | A45F 3/005 |
| 10,010,198 | B2 * | 7/2018 | Dubois | A47G 9/086 |
| 10,136,685 | B2 * | 11/2018 | Beck | A41D 13/08 |
| D849,407 | S * | 5/2019 | Brady | D3/318 |
| 10,321,776 | B2 * | 6/2019 | Hafeznezami | A47G 9/1081 |
| 2003/0094474 | A1 * | 5/2003 | Rotter | A45F 4/03 224/662 |
| 2007/0113338 | A1 * | 5/2007 | Remblad | A45F 4/06 5/420 |
| 2010/0299800 | A1 * | 12/2010 | Jackson, Jr. | A41D 13/081 2/69 |
| 2017/0127858 | A1 * | 5/2017 | Teh | A47C 7/383 |

* cited by examiner

PORTABLE SUPPORT FOR A BODY PART

BACKGROUND OF THE INVENTION

1. Field of the Invention

Among other things, the present invention includes a portable support capable of supporting a body part such as a head, neck, torso or limb. The portable support is also provided with an inner cavity and outward receptacles for transporting articles and tangibles. Select preferred embodiments of the current invention can also function as a purse or waist pack.

2. Description of the Previous Art

Any discussion of references cited in this Description of the Previous Art merely summarizes the disclosures of the cited references and Applicant makes no admission that any cited reference or portion thereof is relevant prior art. Applicant reserves the right to challenge the accuracy, relevancy and veracity of the cited references.

U.S. Pat. No. 6,708,343-Ceron discloses a combination cushion, carry device and garment apparatus. Ceron's Description of the Invention, in part, reads, "With reference generally now to FIGS. 1 through 10, in one of the many preferable configurations, the combination cushion, carry device, and garment apparatus 5 incorporates, among other elements, a planar member 7, a hood 70, a right sleeve 30, a left sleeve 40, a waistband retainer 50, a carrying system 100, and a pouch 90 . . . Referring now specifically to FIG. 1 and FIG. 2, the flexible planar member 7 incorporates a first surface 10 and an opposing second surface 20. The first surface 10 is made of a first material and the second surface 20 is made of a second material that may be substantially water repellant. The second surface 20 is exposed to the environmental elements when the apparatus 5 is worn as a garment. Additionally, the planar member 7 is formed with a head opening 60 allowing the user's head and neck to pass from the first surface 10 to the second surface 20."

Based on the current record, among other things, Ceron does not disclose, describe or suggest, "A portable support for a user comprising: a) an inner cavity adapted to carry one or more articles; b) a covering including a closable opening to the inner cavity; the covering comprising an outward and an inward side; c) cushion substances riding against portions of the inward side; and c) opposed first and second pivoting wings adapted to fold toward or away from the closable opening such that a user can position the outward side of the portable support against a part of the user for resting the part against the portable support.

U.S. Pat. No. 8,893,332-Kavovit discloses a convertible pillow purse. Kavovit's Detailed Description, in part, reads, "Referring to the Figures, a convertible pillow purse or bag 10 is illustrated. The pillow purse 10 includes a body 12 for carrying articles and at least two handles 14, 16. In certain embodiments, the purse 10 includes a removable shoulder strap 17 coupled to the body 12 so the purse or bag 10 can be carried on a shoulder of a user. The body 12 includes a first pillow portion 18 and a second pillow portion 20 coupled by a flexible support member 22 at a lower portion of each of the first and second pillow portions 18, 20. The flexible support member 22 supports the purse 10, i.e., the first and second pillow portions 18, 20, in an upright position when the flexible support member 22 is placed on a flat, horizontal surface. A periphery or outer circumference of an upper portion of each of the first and second pillow portions 18, 20 are joined by a first zipper assembly 24, or coupling assembly. It is to be appreciated that other devices and means may be employed to join or couple the periphery of the upper portions of the first and second pillow portions together, for example, hook and loop fasteners, also known as Velcro™."

Based on the current record, among other things, Kavovit does not disclose, describe or suggest, "A portable support for a user comprising: a) an inner cavity adapted to carry one or more articles; b) a covering including a closable opening to the inner cavity; the covering comprising an outward and an inward side; c) cushion substances riding against portions of the inward side; and c) opposed first and second pivoting wings adapted to fold toward or away from the closable opening such that a user can position to the outward side of the portable support against a part of the user for resting the part against the portable support.

SUMMARY OF THE INVENTION

Among other things, the current invention allows a user to rest a part of the user's body such as a head, neck, torso or limb against the portable support.

An aspect of the current portable support is to provide a closable opening to an inner cavity for transporting articles.

Still another aspect of the current portable support is to provide one or more pivoting wings that can assist with the adjustment of the portable support to the user's body part being supported.

It is another aspect of the current portable support to provide an inner cavity including one or more holders capable of holding articles.

Yet another aspect of the current portable support is to provide the current portable support with receptacles distinct from the inner cavity where the receptacles are capable of receiving tangibles.

Still another aspect of the current portable support is to provide a detachable carrier for carrying the portable support about the user's torso.

It is another aspect of the current portable support to provide means for securing the pivoting wings above the closeable opening of the portable support's cover.

A preferred embodiment of the present invention can be described as a portable support for a user comprising: a) a covering including a closable opening to an inner cavity of the portable support; the covering comprising an outward and an inward side; b) opposed first and second pivoting wings adapted to fold toward or away from the closable opening; c) the inner cavity positioned between the inward side of the covering and the to first and second pivoting wings, wherein the inner cavity is adapted to carry one or more articles; d) one or more receptacles attached to the outward side of the covering; the receptacles adapted to carry one or more tangibles; e) a first connector attached to the outward side proximate the first pivoting wing and a second connector attached to the outward side proximate the second pivoting wing; f) cushion substances attached to portions of the inward side of the covering such that a user can position the portable support against a part of the user for resting the part against the portable support; and g) a detachable carrier adapted for connection to the first and second connectors.

Another preferred embodiment of the present invention can be described as a portable support for a user comprising: a) a covering including a closable opening to an inner cavity of the portable support; the covering comprising an outward and an inward side; b) opposed first and second pivoting wings adapted to fold toward or away from the closable opening; c) the inner cavity positioned between the inward side of the covering and the first and second pivoting wings, wherein the inner cavity is adapted to carry one or more articles; and d) cushion substances attached to portions of the inward side of the covering such that a user can position the portable support against a part of the user for resting the part against the portable support.

Yet another preferred embodiment of the present invention can be described as a portable support for a user comprising: a) an inner cavity adapted to carry one or more articles; b) a covering including a closable opening to the inner cavity; the covering comprising an outward and an inward side; c) cushion substances riding against portions of the inward side; and c) opposed first and second pivoting wings adapted to fold toward or away from the closable opening such that a user can position the outward side of the portable support against a part of the user for resting the part against the portable support.

Still another preferred embodiment of the present invention can be described as a method of using the portable support for a body part comprising the steps of: providing a portable support for supporting a body part of the user, where the portable support comprises an inner cavity capable of carrying one or more articles, a covering including a closable opening to the inner cavity, the covering having an outward and inward side, cushion substances riding against portions of the inward side and opposed first and second pivoting wings adapted to fold toward or from the closeable opening such that the user can position the portable support against the body for resting the body part and positioning the portable support against the user's body part.

It is the novel and unique interaction of these simple elements which creates the system, methods and apparatus, within the ambit of the present invention. Pursuant to Title 35 of the United States Code, descriptions of preferred embodiments follow. However, it is to be understood that the best mode or preferred descriptions do not limit the scope of the present invention.

DESCRIPTION OF THE PREFERRED EMBODIMENTS

The disclosure hereof is detailed to enable those skilled in the art to practice the invention, and the embodiments published herein merely exemplify the present system, methods and devices and do not limit the scope of the claims appended hereto.

The present invention is directed toward the provision of a portable support capable of supporting a body part such as the head, neck, torso or limb or any combination thereof. Meeting a long felt but unfulfilled need, when not supporting a body part, the current portable support, among other things, can also function as a purse or a waist pack. The portable support is adapted to be utilized by the user at home, work or any place therebetween. It is believed the current portable support is beneficial for the user during air, land or water travel. The invention's duality of its combined article carrying capacity and body part support is helpful for users traveling by motor vehicle, plane, rail or water vessel.

Figure 1:
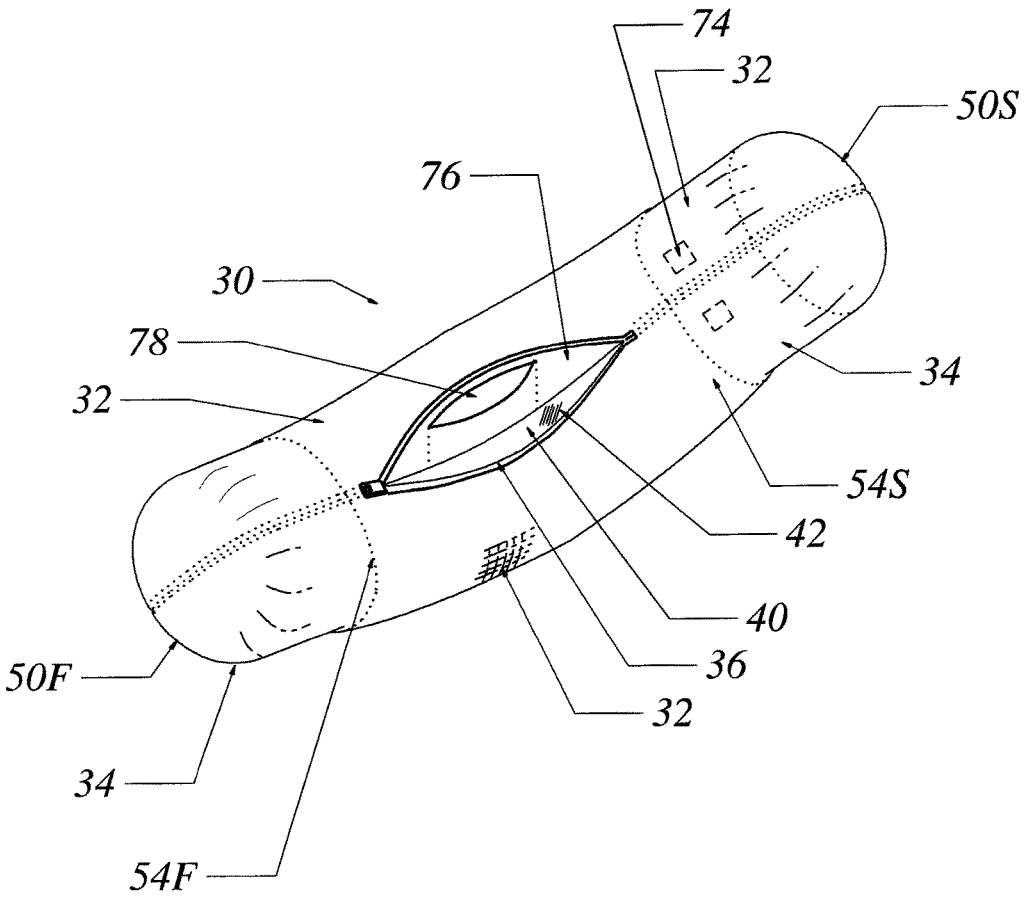
FIG. 1 is a perspective of portable support (30).

FIG. 1 is a perspective of portable support (30). Among other things, portable support (30) includes covering (32), closable opening (36), inner cavity (40) and wings (50F, 50S). Covering (32) includes outward side (34) and inward side opposite outward side (not shown the drawings) facing inner cavity (40). Within the scope of the current invention, covering (32) can be manufactured of any natural or synthetic textile or combination thereof acceptable in the art. When engineering parameters require, select preferred embodiments of portable support (30) can include a single wing (50F).

Portable support (30) is provided with hinges (54F, 54S) (shown in phantom) allowing wings (50F, 50S) to pivot toward or away from closable opening (36). Hinges (54F, 54S) allow additional personalized adjustment of pivoting wings (50F, 50S) against the body part supported by support (30). Within the ambit of the current invention, hinges (54F, 54S) can be manufactured of any materials acceptable in the art, including but not limited to natural or synthetic textiles, metals or combinations thereof.

Within the scope of the current invention, preferred embodiments of inner cavity (40) can include liner (76) and holder (78) attached to liner (76). Other preferred embodiments of inner cavity (40) do not include liner (76) or holder (78). By way of illustration, the FIG. 1 embodiment of inner cavity (40) portrays a first side including a holder (78) attached to liner (76) and second side with cushion substances (42) riding against the inward side of covering (32). Pivoting wings (50F, 50S) are also provided with cushion substances (42), and select preferred embodiments of pivoting wings (50F, 50S) can be provided with one or more magnets (74). Within the scope of the current invention, it has been determined that one or more flexible polyurethane foams are the preferred cushion substances. Flexible polyurethane foams provide appropriate support for the body part resting against portable support (30) and return to their approximate pre-supportive state when portable support (30) is removed from the body part.

Figure 2:
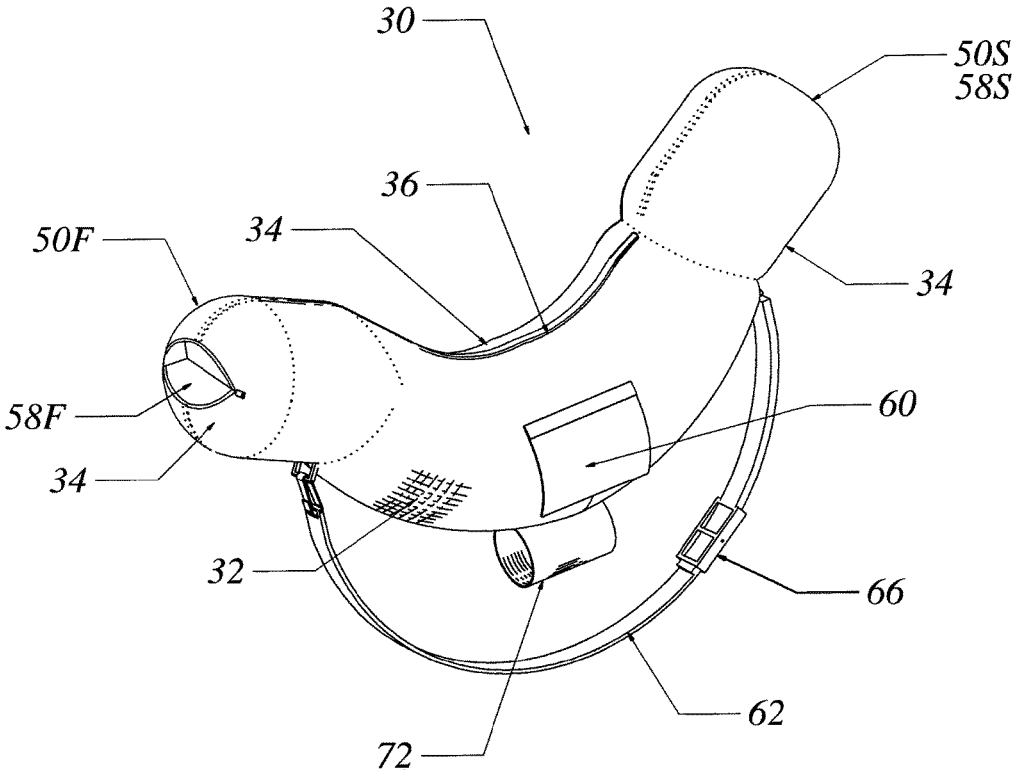
FIG. 2 is a perspective of portable support (30) with closable opening (36) closed.

FIG. 2 is a perspective of a preferred embodiment of portable support (30) with closable opening (36) closed. Receptacle or outer pocket (60) is attached to outward side (34) of covering (32) and is adapted to carry one or more articles. In selected preferred embodiments, an adjustable loop receptacle (72) adapted to carry one or more tangibles is attached to outward side (34) of covering (32). Detachable carrier (62) is connected to portable support (30) by any means acceptable in the art. In selected preferred embodiments, detachable carrier (62) includes adjuster (66) for adjusting the length of detachable carrier (62).

Figure 3:
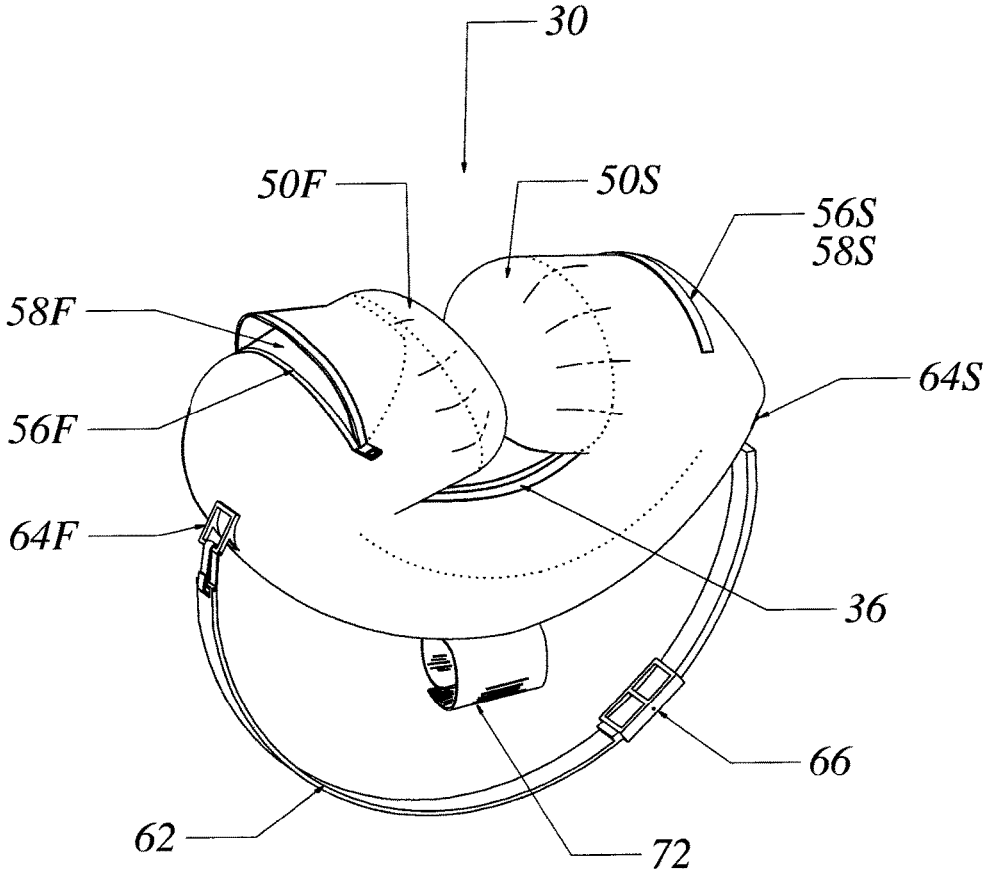
FIG. 3 is a perspective of portable support (30) with pivoting wings (50F, 50S) folded over closable opening (36).

FIG. 3 is a perspective of portable support (30) with pivoting wings (50F, 50S) folded over closable opening (36). In select preferred embodiments of portable support (30), pivoting wings (50F, 50S) are provided with wing openings (56F, 56S) that open to pouches (58F, 58S). As shown in FIGS. 2-3, pouches (58F, 58S) can be positioned at any location of pivoting wings (50F, 50S). Other select preferred embodiments of portable support (30) can include pivoting wings (50F, 50S) without pouches.

Detachable carrier (62) is connected to first and second connectors (64F, 64S). Carrier (62) can be secured or released from first and second connectors (64F, 64S) by a releasable fastener acceptable with in the art that is connected with detachable carrier (62). In select preferred embodiments of portable support (30), magnets (74) embedded in pivoting wings (50F, 50S) or interlockers connected to connectors (64F, 64S) can be utilized to secure pivoting wings (50F, 50S) over closable opening (36).

Within the scope of the present invention, closures for the closable opening, receptacles, holders and pouch openings include but are not limited to buttons, hook and loop materials, magnet fasteners, zippers or any combination thereof.

Figure 4:
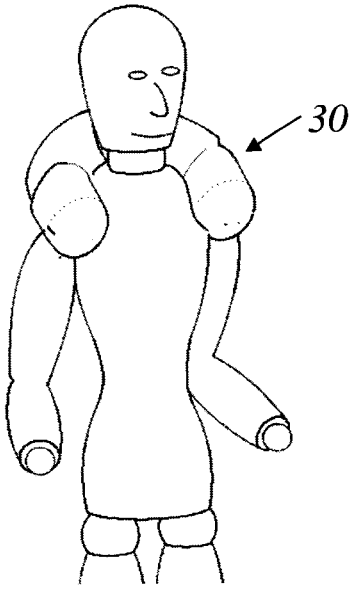
FIG. 4 portrays an example of utilization of the current portable support for a body part.

FIG. 4 portrays an example of utilization of the current portable support for a body part.

Figure 5:
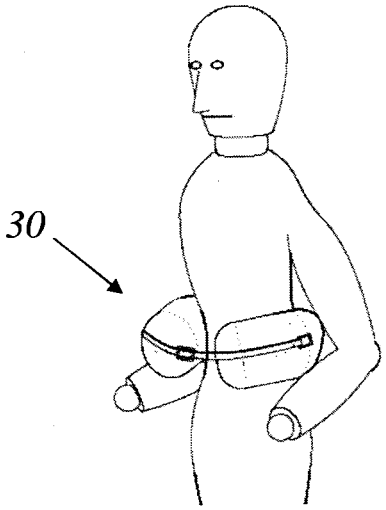
FIG. 5 portrays another example of utilization of the current portable support for a body part.

FIG. 5 portrays another example of utilization of the current portable support for a body part.

Figure 6:
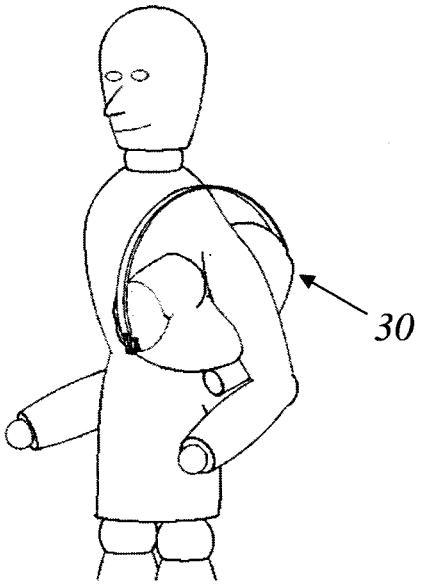
FIG. 6 portrays yet another example of utilization of the current portable support for a body part.
Figure 7:
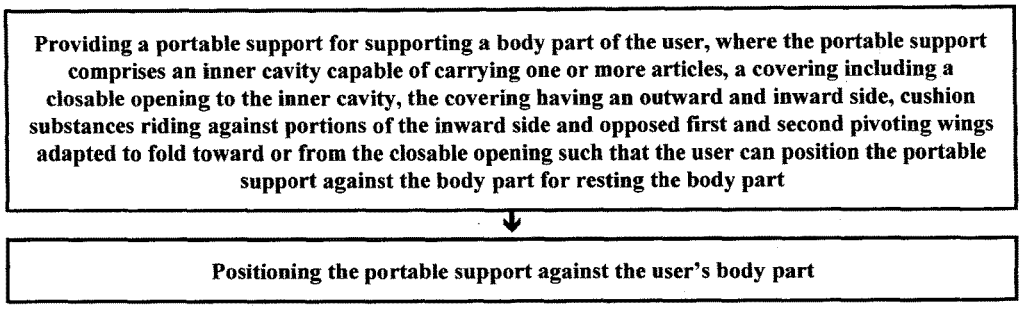
FIG. 7 is an illustration of the steps associated with practicing of a preferred embodiment of the present portable support.
Figure 8:
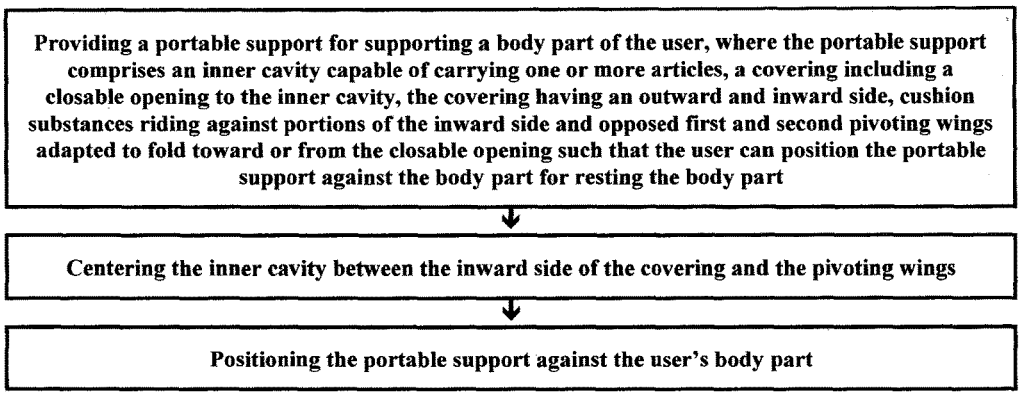
FIG. 8 is a depiction of the steps associated with practicing of another preferred embodiment of the present portable support.
Figure 9:
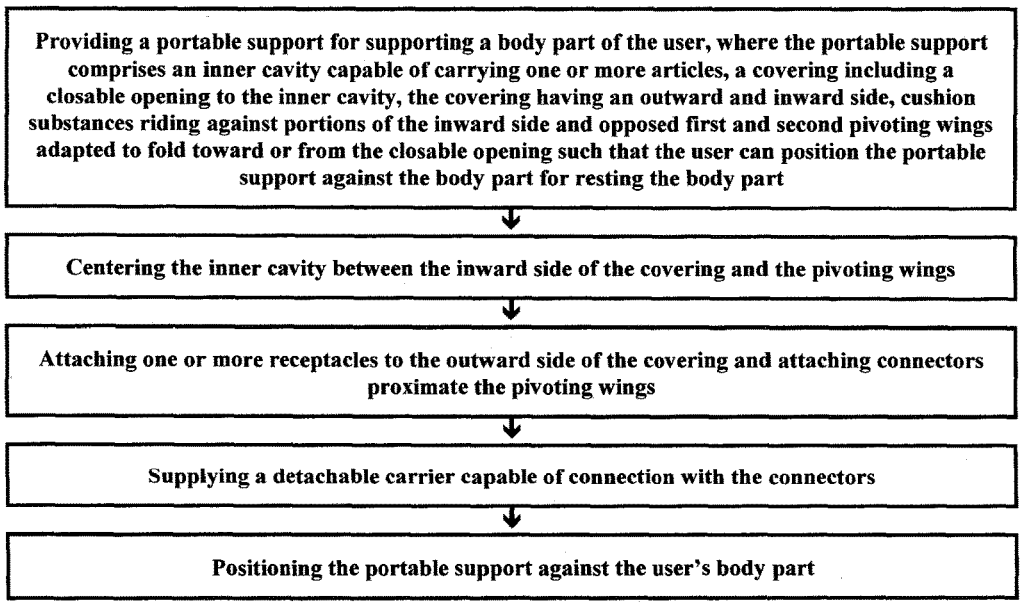
FIG. 9 is an exemplification of the step associated with practicing of yet another preferred embodiment of the current portable support.
Figure 10:
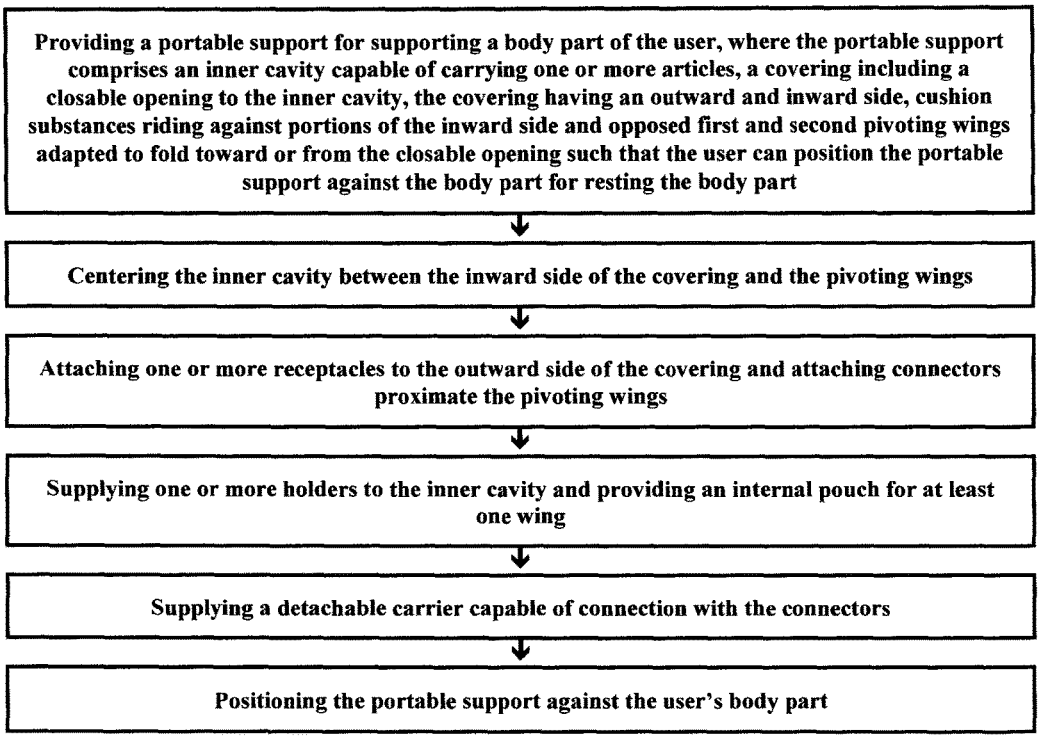
FIG. 10 is another illustration of the steps of associated with still another preferred embodiment of the current portable support.

FIG. 6 portrays yet another example of utilization of the current portable support for a body part.

Select steps associated with the practice of the current portable support are depicted in FIGS. 7-10.

Having disclosed the invention as required by Title 35 of the United States Code, Applicants now pray respectfully that Letters Patent be granted for their invention in accordance with the scope of the claims appended hereto.

What is claimed is:

1. A portable support for a user comprising:

a) a covering including a closable opening to an inner cavity adapted to carry articles; said inner cavity comprising: a first hinge and second hinge; said first hinge creating a first pivoting wing and said second hinge creating a second pivoting wing, wherein said first and second pivoting wings pivot about said first or said second hinges toward or away from said closable opening positioned above an intermediate segment of said inner cavity positioned between and distinct from said wings; and wherein an inward side of said covering creates said inner cavity;

b)

c) one or more receptacles attached to an outward side of said covering;

said receptacles adapted to carry one or more tangibles;

d) a first connector attached to said outward side proximate said first pivoting wing and a second connector attached to said outward side proximate said second pivoting wing;

e) cushion substances attached to portions of said inward side of said covering such that a user can position said portable support against a part of said user for resting said part against said portable support; and f) a detachable carrier adapted for connection to said first and second connectors.

2. The portable support of claim 1, wherein:

a) said inner cavity comprises one or more holders; and b) at least one pivoting wing comprises an internal pouch.

3. The portable support of claim 2, wherein said cushion substances comprise flexible polyurethane foams.

4. The portable support of claim 3, wherein said portable support is adapted to support a head, neck, torso or limb or a combination thereof.

5. The portable support of claim 4, wherein closures for said closable opening, receptacles, holders and internal pouch comprise buttons, hook and loop materials, magnet fasteners, zippers or any combination thereof.

6. The portable support of claim 5, wherein magnets, connector interlockers or any combination thereof secure said pivoting wings over said closable opening.

7. The portable support of claim 6, wherein liner is positioned between said cushioned substances and said one or more holders.

8. A portable support for a user comprising:

a) a covering including a closable opening to an inner cavity; said inner cavity comprising: a first hinge and second hinge; said first hinge creating a first pivoting wing and said second hinge creating a second pivoting wing, wherein said first and second pivoting wings pivot about said first or said second hinges toward or away from said closable opening positioned above an intermediate segment of said inner cavity positioned between and distinct from said wings; and wherein an inward side of said covering creates said inner cavity;

b); and cushion substances attached to portions of said inward side of said covering such that a user can position said portable support against a part of said user for resting said part against said portable support.

9. The portable support of claim 8 comprising:

a) one or more receptacles attached to said outward side of said covering; said receptacles adapted to carry one or more tangibles;

b) a first connector attached to an outward side proximate said first pivoting wing and a second connector attached to said outward side proximate said second pivoting wing; and c) a detachable carrier adapted for connection to said first and second connectors.

10. The portable support of claim 9, wherein:

a) said inner cavity comprises one or more holders; and b) at least one pivoting wing comprises an internal pouch.

11. The portable support of claim 10, wherein said cushion substances comprise flexible polyurethane foams.

12. The portable support of claim 11, wherein said portable support is adapted to support a head, neck, torso or limb or a combination thereof.

13. The portable support of claim 12, wherein:

a) closures for said closable opening, receptacles, holders and internal pouch comprise buttons, hook and loop materials, magnet fasteners, zippers or any combination thereof;

b) magnets, connector interlockers or any combination thereof secure said pivoting wings over said closable opening; and c) liner is positioned between said cushioned substances and said one or more holders.

14. A portable support for a user comprising:

a single-piece covering comprising an outward side and an inward side and including a closable opening to an inner cavity; said inner cavity comprising: a first hinge and second hinge; said first hinge creating a first pivoting wing and said second hinge creating a second pivoting wing, wherein said first and second pivoting wings pivot about said first or said second hinges toward or away from said closable opening positioned above an intermediate segment of said inner cavity positioned between and distinct from said wings; and wherein said inward side of said covering creates said inner cavity.

15. The portable support of claim 14 comprising:

a) one or more receptacles attached to said outward side of said covering; said receptacles adapted to carry one or more tangibles;

b) a first connector attached to said outward side proximate said first pivoting wing and a second connector attached to said outward side proximate said second pivoting wing; and c) a detachable carrier adapted for connection to said first and second connectors.

16. The portable support of claim 15, wherein:

a) said inner cavity comprises one or more holders; and b) at least one pivoting wing comprises an internal pouch.

17. The portable support of claim 16 comprising cushion substances.

18. The portable support of claim 17, wherein said portable support is adapted to support a head, neck, torso or limb or a combination thereof.

19. The portable support of claim 18, wherein:

a) closures for said closable opening, receptacles, holders and internal pouch comprise buttons, hook and loop materials, magnet fasteners, zippers or any combination thereof;

b) magnets, connector interlockers or any combination thereof secure said pivoting wings over said closable opening; and c) liner is positioned between said cushioned substances and said one or more holders.

* * * * *